US005357861A

United States Patent [19]

d'Arbelles et al.

[11] Patent Number: 5,357,861

[45] Date of Patent: Oct. 25, 1994

[54] MEDICAL STAMP SYSTEM AND METHOD OF USE

[76] Inventors: Rodolfo d'Arbelles; Maryann d'Arbelles, both of Rte. 1 Box 661-C-7, High Springs, Fla. 32643

[21] Appl. No.: 104,532

[22] Filed: Aug. 11, 1993

[51] Int. Cl.[5] ..... B41F 31/00

[52] U.S. Cl. ..... 101/327; 101/333; 101/406; 206/361; 206/363; 206/438

[58] Field of Search ..... 101/327, 333, 372, 405, 101/406, 360; 206/361, 363, 368, 373, 438, 459.5, 524.3, 822, 823, 570, 572; 211/69.2, 69.3, 69.4, 39

[56] References Cited

U.S. PATENT DOCUMENTS

| | | | |
|---|---|---|---|
| 545,949 | 9/1895 | Dodge | 206/361 |
| 736,328 | 11/1903 | Wilson | 206/370 |
| 941,608 | 11/1909 | Benson | 206/572 |
| 2,615,562 | 10/1952 | Rothbardt | 206/370 |
| 2,925,100 | 2/1960 | Senger | 206/363 |
| 3,225,914 | 12/1965 | Klein et al. | 206/459.5 |
| 3,388,662 | 6/1968 | Ravreby | 101/333 |
| 3,951,062 | 4/1976 | Abramson | 101/372 |
| 4,862,772 | 9/1989 | Piperato | 206/363 |
| 4,986,175 | 1/1991 | Boehringer et al. | 101/327 |
| 5,000,484 | 3/1991 | Phelan | 283/75 |
| 5,014,617 | 5/1991 | Lesyk | 101/333 |
| 5,133,254 | 7/1992 | Kirkwood | 101/372 |
| 5,193,855 | 3/1993 | Shamos | 283/117 |

*Primary Examiner*—Eugene H. Eickholt
*Attorney, Agent, or Firm*—Michael J. Colitz, Jr.

[57] ABSTRACT

A medical stamp system and method of use, the system comprising, in combination, a stamp having a lower portion and an upper portion, the lower portion terminating in a planar surface, a dye on the lower surface with indicia indicative of an intended course of medical action; and a box having a first region for receipt of the stamp and a minor region coupled to and offset from the major region, the minor region having a recess and ink pad within the recess for the receipt of indelible ink, the recess and pad being of the size to receive the planar surface and dye of the stamp, the box also having a lid to cover the first and second regions of the box with indicia of the responsible position on the exterior surface of the box.

5 Claims, 3 Drawing Sheets

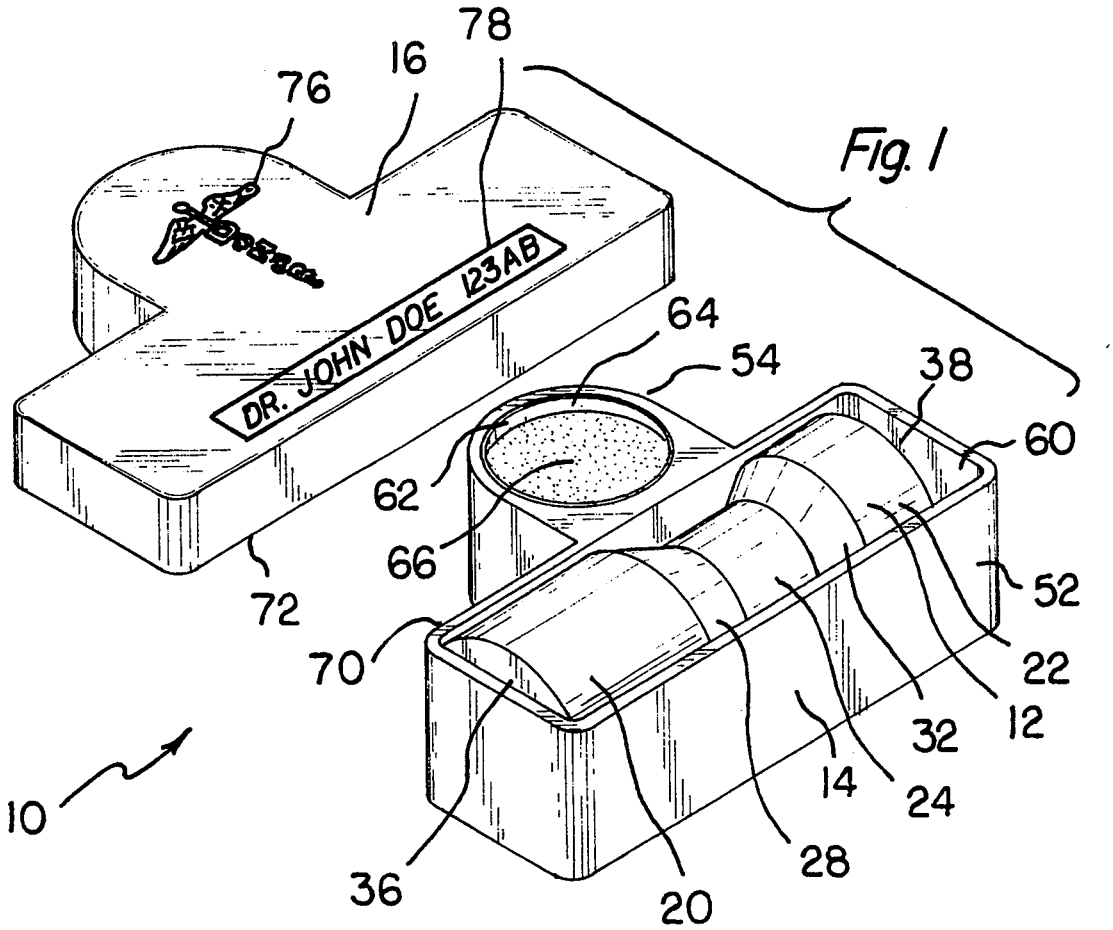
Fig. 1
Fig. 2
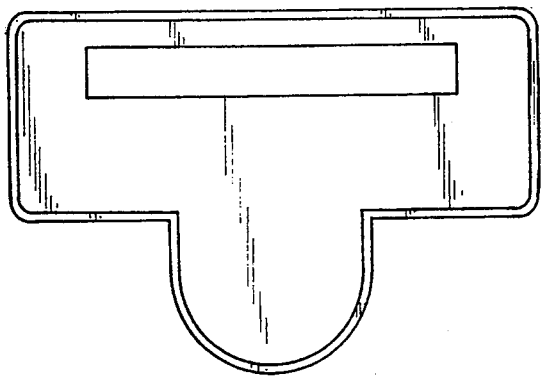

MEDICAL STAMP SYSTEM AND METHOD OF USE

BACKGROUND OF THE INVENTION

1. Field of the Invention

The present invention relates to a medical stamp system and method of use and more particularly pertains to a medical stamp system which is usable by a physician in marking a patient with indicia for withholding extraordinary medical care after receiving appropriate authorization, the system comprising a stamp having a die for forming indicia at one end and a box having a major region for receipt of the stamp and a minor region for receiving indelible ink for use in association with the die, the box also having a lid to cover the major and minor regions of the box.

2. Description of the Prior Art

The use of medical stamp systems is well known in the prior art. More specifically, stamp systems have been heretofore devised and utilized for the purpose of marking a wide variety of objects. They are known to consist basically of familiar, expected and obvious structural configurations, notwithstanding the myriad of designs encompassed by the crowded prior art which have been developed for the fulfillment of countless objectives and requirements.

In this respect, the medical stamp system and method of use according to the present invention substantially depart from the conventional concepts and designs of the prior art, and in so doing provides an apparatus and method primarily developed for the purpose of marking a patient with an intended course of medical action or inaction, or any medical message that may be appropriate.

The prior art discloses a wide variety of stamps and stamp systems. The designs of stamps of plural components but not in systems configuration, are shown in U.S. Pat. Nos. Des. 266,257 to Aherns; Des. 280,911 to Rhoades; and Des. 290,469 to Boehringer. None of these devices are systems configured of stamps and boxes and none are designed for use for medical marking as is the present invention. In addition, utility patents to stamps are disclosed in U.S. Pat. Nos. 4,594,943 to Nettesheim; 4,986,175 to Boehringer and 5,174,208 to Fink. Here again none of the prior art stamps are in a systems configuration to include a stamp and box as in the present invention. Further, no such prior art stamp is designed for use in medical purposes as is the present invention.

Therefore, it can be appreciated that there exists a continuing need for new and improved stamp systems which can be utilized for medical purposes. In this regard, the present invention substantially fulfills this need.

SUMMARY OF THE INVENTION

In view of the foregoing disadvantages inherent in the known types of stamps and stamp systems now present in the prior art, the present invention provides an improved stamp system configuration and method of use wherein the same can be utilized for marking patients for medical purposes. As such, the general purpose of the present invention, which will be described subsequently in greater detail, is to provide a new and improved medical stamp system and method of use including apparatuses and methods which have all the advantages of the prior art stamps and stamp systems and none of the disadvantages.

To attain this, the present invention essentially comprises a method of use and medical stamp system for use by a physician marking a patient with an intended course of medical action, the system comprising, in combination a stamp having a cylindrical upper portion, a cylindrical lower portion and a cylindrical central portion therebetween, the stamp having an conical upper portion between the upper and central portion and a conical lower portion between the lower and central portions, the cylindrical upper and lower portions being of an essentially common diameter with the length of the upper portion being greater than the length of the lower portion, the stamp having opposed planar surfaces at the ends of the upper and lower portions, the stamp having a die for forming indicia on the planar surface of the lower portion with such indicia including caduceus indicative of the medical profession and the term MyWil indicative of an intended course of medical action; a box having a generally rectangular major portion for receipt of the stamp, the box also having a minor region coupled to and offset from the major region with a downwardly extending recess, a fluid impervious liner within the recess, an ink pad within the liner and recess, and indelible ink within the ink pad, with the recess, liner and pad being of a size to receive the lower portion of the stamp for inking the die, the box also having a lid to cover the major and minor regions of the box, the lid having on its exterior surface a caduceus indicative of the medical profession and the name and specific number of a responsible physician.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved medical stamp system, method and apparatus, which has all the advantages of the prior art stamps and stamp systems and none of the disadvantages.

It is another object of the present invention to provide a new and improved medical stamp system and method of use which may be easily and efficiently manufactured and marketed.

It is a further object of the present invention to provide a new and improved medical stamp system and method of use which is of a durable and reliable construction.

An even further object of the present invention is to provide a new and improved medical stamp system and method of use which is susceptible of a low cost of manufacture with regard to both materials and labor, and which accordingly is then susceptible of low prices of sale to the consuming public, thereby making such medical stamp systems economically available to the buying public.

Still yet another object of the present invention is to provide a new and improved medical stamp system and method of use which provides in the apparatuses and methods of the prior art some of the advantages thereof, while simultaneously overcoming some of the disadvantages normally associated therewith.

Still another object of the present invention is to conveniently house a medical stamp and indelible ink in a box for convenient storage and use.

Yet another object of the present invention is to mark a patient with an intended course of medical action or instructions to withhold extraordinary medical procedures by marking DNR (do not resuscitate), on the chest of the patient over the heart.

Even still another object of the present invention is to attain authorization to withhold extraordinary medical procedures when a patient is appropriately diagnosed and to mark the patient with an indelible ink appropriately to insure compliance with the authorized wishes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of a stamp and box including the lid constructing in accordance with the principles of the present invention.

FIG. 2 is a bottom view of the lid of the box as shown in FIG. 1.

DESCRIPTION OF THE PREFERRED EMBODIMENT

Figure 3:
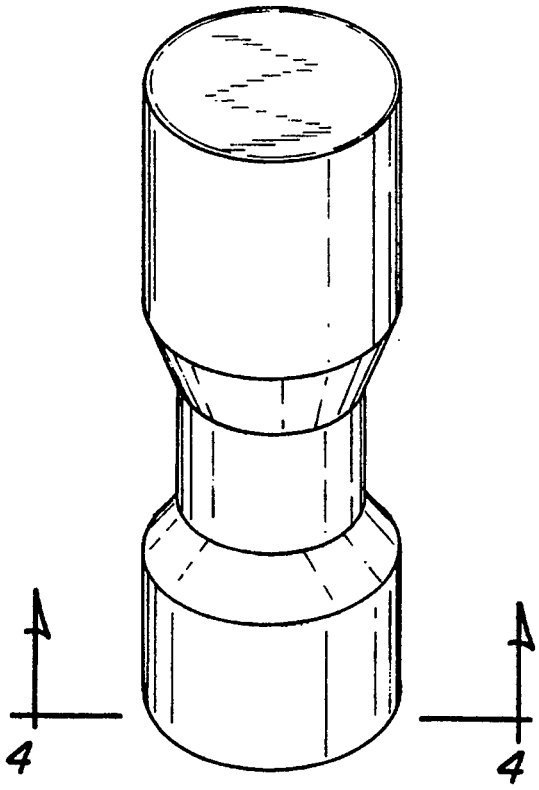
FIG. 3 is a perspective illustration of the stamp shown in FIG. 1.
Figure 4:
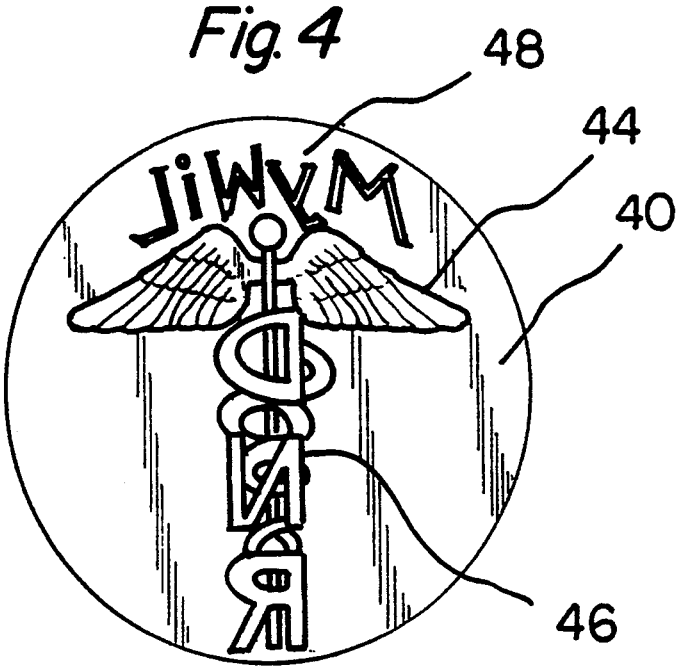
FIG. 4 is a bottom view of the stamp showing the dye and indicia of the die.

With reference now to the drawings, and in particular to FIG. 1 thereof, a new and improved medical stamp system adapted for use in carrying out the method, embodying the principles and concepts of the present invention and generally designated by the reference numeral 10 will be described.

More specifically, it will be noted that the system 10 is comprised of two major components, the stamp 12 and the box 14. The box 10 includes a lid 16 positionable over the entire upper surface of the box. The stamp 12 is formed with an cylindrical upper portion 20 and a cylindrical lower portion 22. A cylindrical central portion 24 is located therebetween. These upper, lower and central portions are coupled with an conical upper portion 28 between the upper and central portions. A similarly shaped but oppositely oriented conical lower portion 32 is located between the lower and central portions.

The stamp has opposed planar surfaces 36 and 38 at the ends of the upper and lower portions. The planar surface at the lower portion 38 has a die 40 formed with markings or indicia. In the preferred embodiment such indicia includes a caduceus 44 which is an indication of the medical profession. In addition, writing 46 is provided indicative of the medical course of action intended or, more particularly the desire to withhold extraordinary medical attention on the assumption that the patient has been so diagnosed and that appropriate authorizations have been obtained for such withholding of medical attention. The preferred indicia for conveying such message that the patient is not to be resuscitated under an aggravated medical condition by the initials D.N.R., a shorthand designation for "do not resuscitate". This designation is known universally to members to the medical profession both doctors and nurses as well as other health care professionals including paramedics. In addition, the phrase MyWil 48 is also provided as an indicia to indicate in a shorthand manner, that such instruction Do Not Resuscitate is the will of the patient marked with such indicia. All of such indicia is preferrably located on the chest over the heart.

The second component of the system is the box 14. The box has a major region 52 and a minor region 54, as well as a cooperative positionable lid 16. The major region of the box is of a generally rectangular shape. It has a recess 60 for the receipt of the stamp 12. The box also has a minor region 54. The minor region is 54 coupled to the major region as an extension thereof. It is preferably offset to one side, the back side, and takes a semicircular configuration about a vertical axis as compared to the rectangular configuration of the major region 52. The minor region 54 is also formed with a recess 62. The recess 62 has a fluid impervious liner 64 therein. Also within the recess and liner is an ink pad 66 containing an indelible ink. The recess 62, liner 64, and pad 66 are of a size and configuration, preferably circular, to receive the lower part of the stamp 12 whereby the die 40 with its indicia, 44, 46, and 48, may contact the ink of the pad for wetting prior to use in marking a patient.

The box also has a lid 16 shaped to conform with and cover the major and minor regions 52 and 54 of the box 14. Peripheral cooperating flanges 70 and 72 are provided at adjacent surfaces at the upper edge of the box and lower edge of the lid to preclude inadvertent shifting or slippage of the lid 54 from the box 14. It is preferred that the lid has on its exterior surface a caduceus 76 indicative of the medical profession. Also located on the exterior surface is a metal plate 78 adapted to be engraved with the name and specific identification number of the physician responsible for the specific stamp and patient to be marked thereby.

Figure 5:
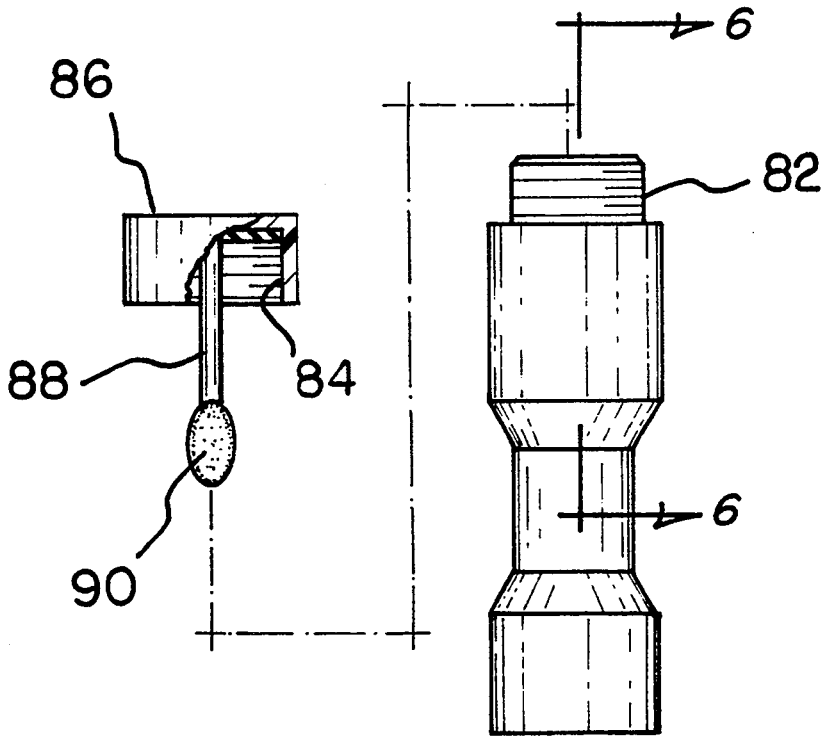
FIG. 5 shows a stamp constructed in accordance with an alternate embodiment of the invention with the upper portion formed with a cap having a swab positionable within a well of ink remover fluid, all within the upper portion of the stamp.
Figure 6:
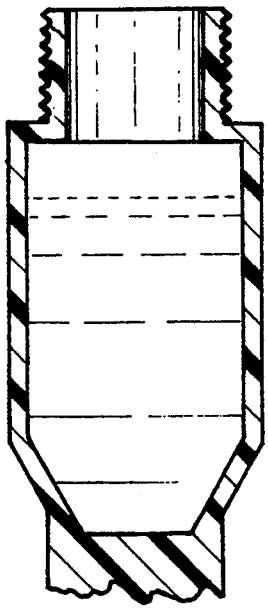
FIG. 6 is a sectional view taken along line 6—6 of FIG. 5.

Shown in FIGS. 5 and 6 is an alternate embodiment of the invention. In accordance with the alternate embodiment of the invention, the upper end of the upper portion of the stamp is formed with external threads 82. Extending through the threads into the upper portion of the stamp is a recess 84 in which is located a fluid for eradicating the indelible ink previously placed upon the patient. Cooperable with the external threads are the internal threads 84 formed on the interior surface of a cap 86. The cap 86 is adapted to be threaded onto the remainder of the stamp in a locking orientation. The cap may be unthreaded from the remainder of the stamp for its separation in the conventional manner.

Extending downwardly from the interior surface of the cap 86 is a rod 88 having at its lower end a swab pad 90. The swab pad is adapted to be located within the ink removing fluid of the recess. This arrangement provides for a convenient separation of the cap 86 and swab pad 90 for the removal of indicia from the patient as would be required if the authorization to withhold extraordinary medical treatment were to be withdrawn.

In operation and use, the method of practicing the present invention includes the providing of a stamp 12 and box 14 in accordance with that described above. The method further includes the step of diagnosing the patient as having a condition wherein chances of recovery are essentially negligible. Thereafter, an authorization to withhold extraordinary medical procedures and care from such diagnosed patients would be obtained, so long as such is the desire of the patient and or the guardian who as is legally appropriate. Thereafter, with such authorization obtained as a result of the diagnosis, the physician would remove the stamp 12 from the box 14, contact its die to the indelible ink of the pad 66 and mark the patient on the chest over the heart with the indicia of the caduceus as well as the DNR designation, Do Not Resuscitate, as well as the MyWil designation to indicate such to be the will, intention and desire of the patient as given directly or through the legal guardian.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the U.S. is as follows:

1. A medical stamp system for use by a physician marking a patient with an intended course of medical action, the system comprising, in combination:

a stamp having a cylindrical upper portion, a cylindrical lower portion and a cylindrical central portion therebetween, the stamp having a conical upper portion between the upper and central portion and a conical lower portion between the lower and central portions, the cylindrical upper and lower portions being of an essentially common diameter with the length of the upper portion being greater than the length of the lower portion, the stamp having opposed planar surfaces at the ends of the upper and lower portions, the stamp having a die for forming indicia on the planar surface of the lower portion with such indicia including caduceus indicative of the medical profession and a term (MyWil) referring to the patient's will indicative of an intended course of medical action;

a box having a generally rectangular major portion for receipt of the stamp, the box also having a minor region coupled to and offset from the major region with a downwardly extending recess, a fluid impervious liner within the recess, an ink pad within the liner and recess, and indelible ink within the ink pad, with the recess, liner and pad being of a size to receive the lower portion of the stamp for inking the die, the box also having a lid to cover the major and minor regions of the box, the lid having on its exterior surface a caduceus indicative of the medical profession and the name and specific number of a responsible physician.

2. A medical stamp system for marking a patient with an intended course of action or message comprising:

a stamp having a lower portion and an upper portion, the lower portion terminating in a planar surface, a dye on the lower surface with indicia indicative of an intended course of medical action or message; and a box having a first region for receipt of the stamp and a minor region coupled to and offset from the major region, the minor region having a recess and ink pad within the recess for the receipt of indelible ink, the recess and pad being of the size to receive the planar surface and dye of the stamp, the box also having a lid to cover the first and second regions of the box with indicia thereon representing the responsible physician on the exterior surface of the box.

3. The system as set forth in claim 2 wherein the upper portion includes threads on its exterior surface and a recess formed interiorly thereof and a cap with threads coupleable with the threads of the upper portion and a swab extending downwardly from the cap into the recess whereby indelible ink remover in the recess of said upper portion will be contacted by the swab for use in removing indelible ink placed on a patient by the die of the stamp.

4. The system as set forth in claim 2 wherein the dye is formed with a caduceus indicative of the medical profession.

5. The system as set forth in claim 2 and further including indicia on the exterior surface of the box indicative of the medical profession.

* * * * *